US009187852B2

(12) United States Patent
Dilo

(10) Patent No.: US 9,187,852 B2
(45) Date of Patent: Nov. 17, 2015

(54) FEED DEVICE FOR SUPPLYING INDIVIDUALIZED FIBERS OR FIBER FLOCKS TO A TRANSPORT DEVICE

(71) Applicant: Oskar Dilo Masc hinenfabrik KG, Eberbach (DE)

(72) Inventor: Johann Philipp Dilo, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 228 days.

(21) Appl. No.: 13/959,953

(22) Filed: Aug. 6, 2013

(65) Prior Publication Data

US 2014/0034399 A1 Feb. 6, 2014

(30) Foreign Application Priority Data

Aug. 6, 2012 (EP) ..... 12179382
Dec. 28, 2012 (EP) ..... 12199625

(51) Int. Cl.
*D04H 1/736* (2012.01)
*D04H 11/08* (2006.01)
*D01G 23/04* (2006.01)

(52) U.S. Cl.
CPC ..... *D04H 1/736* (2013.01); *D01G 23/04* (2013.01); *D01G 23/045* (2013.01); *D04H 11/08* (2013.01)

(58) Field of Classification Search
CPC ..... D04H 1/732; D04H 1/736; D01G 23/04
USPC ..... 19/296, 300, 303
See application file for complete search history.

(56) References Cited

U.S. PATENT DOCUMENTS

| | | | | |
|---|---|---|---|---|
| 5,121,523 | A * | 6/1992 | Brutsch et al. | 19/97.5 |
| 5,257,438 | A * | 11/1993 | Faas et al. | 19/145.5 |
| 5,737,806 | A * | 4/1998 | Leifeld et al. | 19/98 |
| 6,173,478 | B1 * | 1/2001 | Patelli et al. | 19/105 |
| 9,003,609 | B2 * | 4/2015 | Dilo | 19/300 |
| 2004/0195717 | A1 | 10/2004 | Kataoka | |
| 2005/0098910 | A1 * | 5/2005 | Andersen | 264/39 |
| 2005/0198783 | A1 * | 9/2005 | Rubenach | 19/105 |
| 2014/0033480 | A1 * | 2/2014 | Dilo | 19/65 A |

FOREIGN PATENT DOCUMENTS

| | | | |
|---|---|---|---|
| CH | 490526 | A | 5/1970 |
| DE | 3141537 | A1 | 5/1983 |
| DE | 290448 | A5 | 5/1991 |
| EP | 0972866 | A2 | 1/2000 |
| EP | 2009149 | A1 | 12/2008 |

OTHER PUBLICATIONS

Excerpts of European Search Report for EP Application No. 12 19 9625. 2 pages. Date: Apr. 24, 2013.

* cited by examiner

*Primary Examiner* — Shaun R Hurley
(74) *Attorney, Agent, or Firm* — Jansson Munger McKinley & Shape Ltd.

(57) ABSTRACT

The feed device for supplying individualized fibers or fiber flocks to a transport device, which serves to transport the formed fleece or fiber flock mat onward, includes a plurality of feed segments arranged horizontally next to each other and a plurality of individually actuatable feed rollers, wherein a separate feed roller is assigned to each feed segment. In addition, at least one driven opening cylinder, which cooperates with each feed roller, is also provided.

13 Claims, 8 Drawing Sheets

REPLACEMENT SHEET
2/8

FEED DEVICE FOR SUPPLYING INDIVIDUALIZED FIBERS OR FIBER FLOCKS TO A TRANSPORT DEVICE

CROSS REFERENCE TO RELATED APPLICATIONS

This application claims priority based on European patent applications EP 12 179 382.2, filed Aug. 6, 2012 and EP 12 199 625.0, filed Dec. 28, 2012.

FIELD OF THE INVENTION

The invention relates to a feed device for supplying individualized fibers or fiber flocks to a transport device.

BACKGROUND OF THE INVENTION

When fiber fleeces are produced, fiber flocks are first dispensed from a fiber flock feeder to a transport device, which, in a first alternative, transports them in the form of a fiber flock mat to a fiber web-forming device, preferably a carding machine. In a second alternative, they are transported directly to an aerodynamic fleece former; or, in a third alternative, the fiber flocks are transported directly to a solidification machine such as a needling machine.

In the first alternative, the carded web formed in the fiber web-forming device (which can also be called a single-layer or double-layer fleece) is then sent to a fleece layer, which lays the fiber web to form a multi-layer fleece by cross-lapping. This multi-layer fleece can then be solidified by a suitable solidification machine such as by a needling machine. Overall, the goal is usually to produce a fiber fleece with a very high degree of uniformity. For this purpose, appropriate means of intervening in the process are present at various locations of the production system. For example, in the area between the fiber flock feeder and the web-forming device, the weight, for example, of the fiber flock mat can be measured by a belt weigher, and on this basis the infeed rate of the web-forming device is controlled in such a way that the quantity of fiber material which arrives in the web-forming device per unit time is always the same.

Nevertheless, a belt weigher of this type can determine only the average weight of the fiber flock mat distributed across the width of the transport device and over a certain length in the transport direction. For this reason, the uniformity of the fiber flock stream entering the web-forming device obtained by this equalizing method is only roughly approximate. The mass per unit area of the fiber flock mat can thus vary across the width of the fiber flock mat, a situation which must be tolerated.

In the case of the second and third fleece-forming alternatives mentioned above, attempts have been made in the past through various adjustments within the processing stations and through various design details to dispense the fiber flocks in the fiber flock feeder to form a fiber flock mat and to deliver the individualized fibers in the aerodynamic fleece-forming machine to form a fiber fleece as uniformly as possible over the length and width of the fiber flock mat or fleece. The results, however, have often been in need of improvement.

In addition to making a uniform fiber flock mat or fleece, it can also be advantageous in other cases for the transverse profile and/or longitudinal profile of the fiber flock mat or the fleece to comprise a predetermined type of nonuniformity.

SUMMARY OF THE INVENTION

It is an object of the present invention to provide a feed device which can be used at various locations of a fleece-forming system and which makes it possible to dose the fiber material accurately with respect to location and quantity.

According to an aspect of the invention, the feed device for supplying individualized fibers or fiber flocks to a transport device, which serves to transport the formed fleece or fiber flock mat further onward in a transport direction, comprises a plurality of individually actuatable feed rollers and at least one driven opening cylinder, which cooperates with the feed rollers. The feed device comprises a plurality of feed segments, arranged horizontally next to each other in such a way that a separate feed roller is assigned to each feed segment. In this way, fiber material can be supplied to the transport device in a targeted manner, regardless of whether it serves as starting material for the formation of a fleece or fiber flock mat or whether it is used for follow-up correction of the profile of an existing base fiber product.

Each feed roller is preferably supplied with its own fiber sliver or its own fiber fleece strip. As a result, it is possible to dose the quantity of material per feed segment with especially high precision.

A dispensing device for storing and dispensing a fiber sliver or a fiber fleece strip is preferably assigned to each feed segment in such a way that each feed roller pulls off the fiber sliver or fiber fleece strip provided by the associated dispensing device. In this way, a high degree of spatial resolution is achieved even during the infeed of the dosed material into the feed device.

As an alternative to the dispensing device mentioned above, the feed device can also comprise a fiber flock shaft as a reservoir for the feed rollers.

The local resolution of feed of the individualized fibers or fiber flocks is determined substantially by the width of the individual feed segment. It is preferable here for each feed segment to have a width in the range of 5-100 mm, preferably of 15-30 mm, an even more preferably of 20-25 mm.

In one embodiment of the feed device, each feed roller comprises a set of surface fittings with teeth projecting backwards with respect to the rotational direction of the feed roller, wherein the opening cylinder is driven in the same rotational direction as the feed rollers and comprises a set of surface fittings with teeth projecting forwards with respect to the rotational direction. The fiber material is supplied to the opening cylinder at an angle from below.

Alternatively, in another embodiment of the feed device, each feed roller can comprise a set of surface fittings with teeth projecting backwards with respect to the rotational direction of the feed roller, wherein the opening cylinder is driven in a second rotational direction, which is opposite the rotational direction of the feed rollers, and comprises a set of surface fittings with teeth projecting forwards with respect to the second rotational direction. The fiber material is supplied to the opening cylinder at an angle from above, received by the opening cylinder, and guided around a half circle until it can fall down into a dispensing shaft.

It is preferable to provide exactly one opening cylinder, which extends transversely to the transport direction of the transport device and horizontally over all of the feed segments. Thus the opening cylinder can take the fiber material provided by each feed roller simultaneously from them and then dispense it onto the desired position of the fleece. It is also possible to have one opening cylinder for each feed segment and therefore for each feed roller.

The transverse profile of the fleece or fiber flock mat to be produced can be influenced most effectively when the feed segments are arranged next to each other in a direction transverse to the transport direction of the transport device.

To increase the local resolution of the feed of fiber material even more, at least one other type of roller or conveyor belt can be assigned to each feed segment, wherein the rollers or conveyor belts of the same type of all the feed segments are arranged next to each other in a direction transverse to the transport direction of the transport device and are actuatable independently of each other.

Each feed roller is preferably driven by a servomotor. The use of a separate servomotor for each feed roller ensures the independent actuation of each feed roller and thus a highly accurate profile adjustment of the fleece or fiber flock mat by means of the individually actuated feed segments.

When a dispensing device for a fiber sliver or a fiber fleece strip is used as a material reservoir, a storage drum is preferably arranged between the dispensing device and the feed roller of each feed segment. This storage drum extends transversely to the transport direction of the transported device and horizontally across all the feed segments, and a winding of each fiber sliver or fiber fleece strip provided by the dispensing device is wound around the storage drum. In this way, the feed rollers do not have to take the fiber material directly from the dispensing device but instead can do this at a locally well-defined place on the storage drum.

According to a preferred embodiment of the present invention, two feed devices according to the invention are set up one behind the other to form a fleece-forming system.

If its preferable here for the feed segments of the two feed devices to have the same width and for the feed segments of the second, downstream feed device to be offset from the feed segments of first feed device, preferably by half the width of a feed segment. In this way, an especially uniform fleece can be produced by the double fiber feed process.

The fleece-forming system can comprise, between the first and the second feed device, a measuring device for measuring the mass per unit area of the fleece across its width extending transversely to the transport direction of the transport device in a measuring area of the transport device to determine a transverse profile and a longitudinal profile of the fleece. The system can also comprise an open-loop or closed-loop control unit, which is designed to control the second feed device on the basis of the results of the measuring device in such a way that the second feed device supplies individualized fibers or fiber flocks to the identified thin sections in the fleece to form a uniform fleece, or in such a way that the second feed device supplies individualized fibers or fiber flocks in a targeted manner to form a desired nonuniform transverse profile and/or longitudinal profile of the fleece with thin sections and thick sections. Such a system further refines the fleece-forming process.

BRIEF DESCRIPTION OF THE DRAWINGS

Additional features and advantages of the present invention can be derived from the following description and drawings in which.

DETAILED DESCRIPTION OF THE INVENTION

Figure 1:
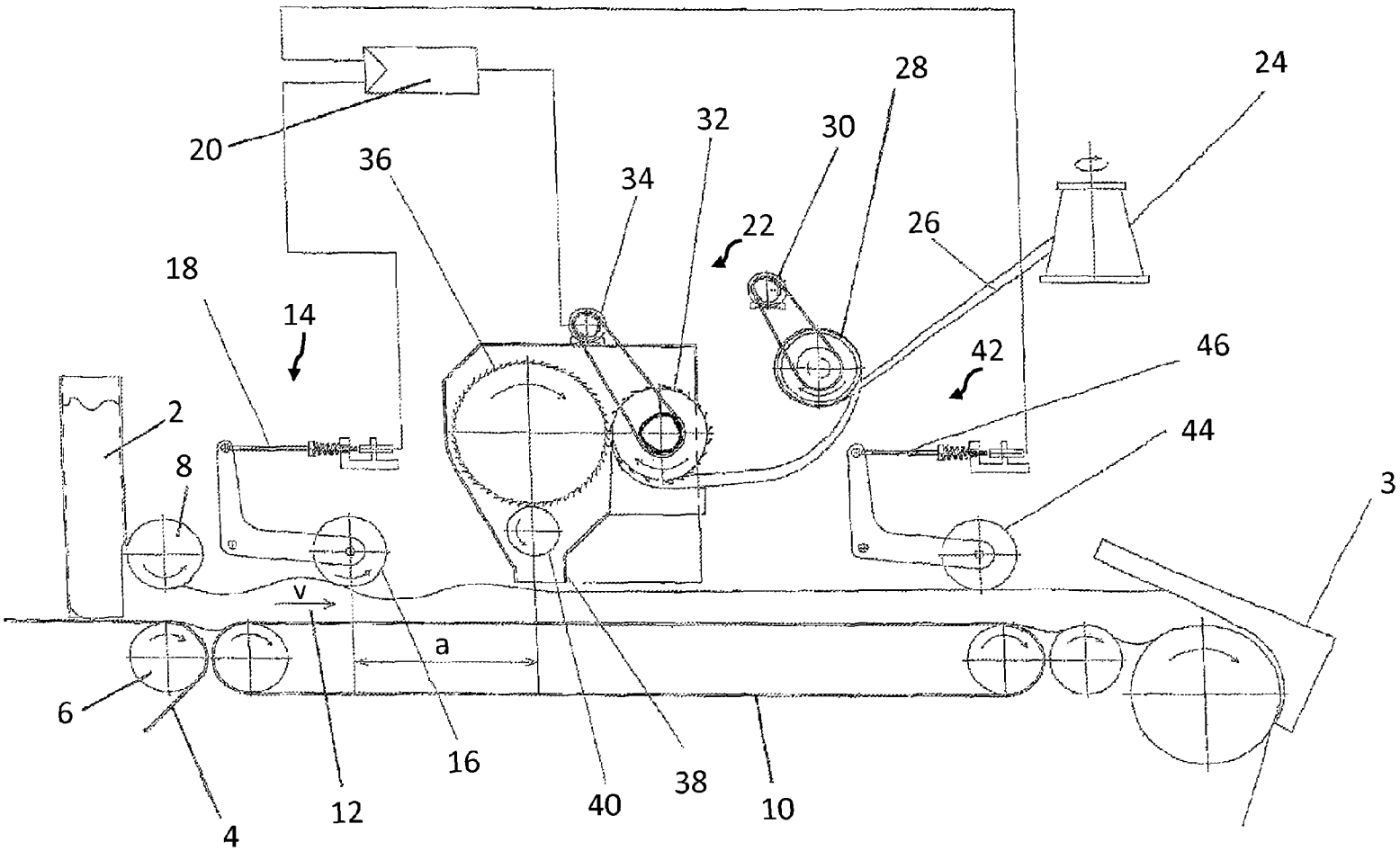
FIG. 1 shows a cross-sectional side view of a preferred embodiment of a device for forming a uniform or profiled fiber flock mat with a first embodiment of a feed device according to the invention, which is used herein as a profile-changing device for a previously produced fiber flock mat.

FIG. 1 shows a device for forming a uniform or profiled fiber flock mat. The device comprises a material dispensing device, which is designed here as a fiber flock feeder 2. Downstream from the device, the fiber flock mat which has been produced is sent to the infeed area of a web former 3, especially a carding machine. The fiber flock mat 12 which is produced can also be sent directly to an aerodynamic fleece former (not shown) or to a solidifying machine (not shown).

Fiber flock feeder 2 dispenses fiber flocks onto an outfeed belt 4, which travels endlessly around a circuit and which is kept under tension by several deflecting pulleys 6, only one of which is shown in the drawing.

To densify the fiber flock material discharged from fiber flock feeder 2, an upper cylinder 8 can also be arranged in the outlet area of fiber flock feeder 2. This upper cylinder 8 is driven in the direction opposite to that of pulley 6 of outfeed belt 4 and thus cooperates with outfeed belt 4 to increase the density of the fiber flock mat and to move it forward toward an endless conveyor belt 10. In the example shown here, outfeed belt 4 and conveyor belt 10 together form a transport device, which handles the further transport of fiber flock mat 12.

In the example shown here, transport device 4, 10 connects fiber flock feeder 2 to web former 3. It is also conceivable that conveyor belt 10 could extend directly underneath fiber flock feeder 2 (see the other figures), which would thus eliminate the need for outfeed belt 4, or that the transport device could comprise still other components in addition to elements 4, 10 shown.

On transport device 4, 10, the fiber flock material, now in the form of a fiber flock mat 12, is moved forward at a variable speed "v" toward the intake area of web former 3 and thus in the transport direction. Conveyor belt 10 can also comprise a belt weigher, which determines an average weight of fiber flock mat 12 in a two-dimensional weighing area, which has a certain length and extends across the entire width of fiber flock mat 12. On this basis, the transport speed "v" of the transport device and thus simultaneously the infeed speed of web former 3 can be controlled as appropriate, so that substantially the same mass flow of fiber flock material always arrives at web former 3 per unit time.

A measuring device 14 is provided, which measures the mass per unit area of fiber flock mat 12 across its width transversely to the transport direction in a measuring area of transport device 4, 10, in order to determine the transverse profile and, on the basis of the movement of transport device, 4, 10, also the longitudinal profile of fiber flock mat 12, especially for the purpose of identifying thin sections and/or thick sections in fiber flock mat 12. Measuring device 14 comprises several measuring segments arranged transversely to the transport direction of fiber flock mat 12 and conducts a separate measurement in each measuring segment. In this way, thin sections or thick sections can be determined in two dimensions, i.e., in the longitudinal and in the transverse direction. The width of one of these measuring segments is in the range of 5-100 mm, preferably of 15-30 mm, and even more preferably of 20-25 mm. A measuring device of this type can be used in addition to the belt weigher or take over its function.

In the embodiment shown in FIG. 1, measuring device 14 is designed as a row of measuring wheels 16, arranged transversely to the transport direction of fiber flock mat 12 and horizontally next to each other. In the cross-sectional side view shown, only one of these measuring wheels 16 can be seen. Each of these measuring wheels 16 can be deflected independently of the others and is connected to an appropriate evaluation unit 18, which detects the deflection of the associated measuring wheel 16 caused by the differences in the thickness, i.e., in the mass per unit area, of fiber flock mat 12. Position sensors for measuring the height of measuring wheels 16 or their mountings or rotational angle meters for determining the rotational angle of measuring wheels 16 or their mountings, for example, could be used for the evaluation unit 18. Thus it is possible to draw a conclusion concerning the mass per unit area of fiber flock mat 12 in the associated measurement segment.

Alternatively, measuring device 14 can be designed as some other type of mechanical measuring device. It is also possible for measuring device 14 to be designed as a radiometric measuring device. In this case, either a radiometric measurement probe is arranged in each measurement segment to determine the mass per unit area of fiber flock mat 12 in the measurement segment in question by means of radiometric measurements, or a single radiometric measurement probe is provided, which can be moved transversely across the width of fiber flock mat 12 and which records the mass per unit area of fiber flock mat 12 continuously or at certain measurement intervals. It is also possible to use a combination of a radiometric and a mechanical measuring device 14.

The results provided by measuring device 14 are transmitted to an open-loop or preferably closed-loop control unit 20, which controls a feed device 22, which, in the application in question here, can also be called a profile-changing device, on the basis of the results of measuring device 14. Feed device 22 is arranged in a profile-changing area of transport device 4, 10, downstream from the measurement area. Control unit 20 controls feed device 22 in such a way that feed device 22 either supplies individualized fibers or fiber flocks to the identified thin sections in fiber flock mat 12 to make fiber flock mat 12 uniform and/or that feed device 22 supplies individualized fibers or fiber flocks in a targeted manner to form a desired nonuniform transverse profile and/or longitudinal profile of fiber flock mat 12 with thin sections and thick sections.

The automatically controlled supply of individualized fibers or fiber flocks proceeds by independent actuation of several feed segments of feed device 22, which are arranged transversely to the transport direction and horizontally next to each other. The width of one of these feed segments corresponds preferably to the width of one of the measurement segments. It lies therefore in the range of 5-100 mm, preferably of 15-30 mm, and even more preferably of 20-25 mm.

In the embodiment shown in FIG. 1, the various feed segments of feed device 22 are arranged transversely to the transport direction and thus cannot be seen in the side view of the drawing. Assigned to each feed segment is a dispensing device 24 for storing and dispensing a carded fiber sliver 26 or a fiber fleece strip. In the exemplary embodiment shown in FIG. 1, dispensing device 24 is designed as a spool, but it can also be in the form of a sliver can or the like. Fiber sliver 26 or the fiber fleece strip travels from dispensing device 24 to a preferably rubber-coated storage drum 28, which is arranged horizontally, transversely to the transport direction, and which extends preferably across all of the feed segments. A winding of each fiber sliver 26 or of each fiber fleece strip supplied by dispensing device 24 is wound around storage drum 28, one next to the other. Storage drum 28 is driven in one rotational direction (see the corresponding arrow in the drawing), preferably by means of a servomotor 30 and preferably continuously at relatively slow speed. In certain embodiments, storage drum 28 can also be omitted.

In the preferred embodiment shown in FIG. 1, a one-piece storage drum 28 is present, which holds the various strands of fiber sliver 26 or fiber fleece strip for all the feed segments simultaneously, one next to the other. It is also possible to provide a separate storage drum for each feed segment.

Also assigned to each feed segment is a feed roller 32, driven by a servomotor 34 and rotating in the same direction. Feed roller 32 draws off carded fiber sliver 26 or the fiber fleece strip provided by the associated dispensing device 24, either directly or indirectly by way of storage drum 28. Although each feed segment comprises its own feed roller 32, only one feed roller 32 can be seen in the drawing because of the way they are arranged one behind the other. Each feed roller 32 preferably comprises a set of surface fittings consisting of teeth projecting backwards with respect to the direction of rotation.

A special advantage of interposing storage drum 28 is that, because carded fiber slivers 26 or fiber fleece strips are wound only loosely around storage drum 28, they are able to slip around it. This slipping effect occurs in all of the feed segments in which feed roller 32 is not being driven at all or is turning more slowly than storage drum 28. Only when feed roller 32 turns faster than storage drum 28 will the corresponding winding of carded fiber sliver 26 or of the fiber fleece strip be pulled taut around storage drum 28, with the result that the material will be drawn away from storage drum 28.

Depending on the quantity of fiber material to be dispensed, feed rollers 32 can have any possible speed profile, including a plateau profile (e.g., in the form of a truncated pyramid) with plateaus of equal height but different lengths.

Carded fiber sliver 26 or fiber fleece strip carried along by feed roller 32 is transported to an opening cylinder 36, which preferably has a one-piece design and extends horizontally, transversely to the transport direction, across all of the feed segments. It is also possible, however, to provide a separate opening cylinder 36 for each feed segment.

In the example shown here, opening cylinder 36 is driven in the same rotational direction as feed rollers 32. In addition, opening cylinder 36 preferably comprises a set of surface fittings consisting of teeth projecting forward with respect to the direction of rotation, as a result of which it is especially effective at opening the twisted or compacted fiber flock material of carded fiber sliver 26 or fiber fleece strip, so that loose fiber flocks or even fine fibers are individualized. These fall into an appropriate dispensing shaft 38, and from there they are guided onto fiber flock mat 12. It is also possible to provide several dispensing shafts 38 next to each other for the various feed segments.

If desired, a cleaning cylinder 40 can be arranged in the area of dispensing shaft 38. This cylinder strips off the fiber flocks adhering to the teeth of opening cylinder 36.

In the example shown here, the centers of feed rollers 32 and of opening cylinder 36 are arranged on the same horizontal line. In addition to the arrangement shown, however, there are also many other design possibilities.

If desired, the result which has been obtained by feed device 22 can be inspected again downstream by a second measuring device 42. Second measuring device 42 can be designed in the same way as measuring device 14. i.e., it can also comprise several measuring wheels 44 and several associated evaluation units 46.

It is also possible to arrange an additional feed device 22 downstream from second measuring device 42 to deal with cases in which the desired uniformity or the desired transverse or longitudinal profile of fiber flock mat 12 has not been achieved in one step.

So that it can exercise its control function properly during the operation of feed device 22, control unit 20 must therefore take into account not only the local arrangement of the measuring segments and feed segments and the associated measurement data but also the distance "a" between the measuring area and the profile-changing area as well as the associated speed "v" of the transport device, here conveyor belt 10.

When the profile is to be changed, relevant feed roller 32 of the associated feed segment is then driven at the proper time at a certain speed and thus delivers additional fiber or fiber flock material to opening cylinder 36. The correctly dosed quantity of this material then arrives at the desired location on fiber flock mat 12.

There are also other possible ways in which the feed device can be designed. For example, multiple fiber flock shafts can be provided, corresponding to the number of feed segments. Each shaft would then be supplied in a targeted manner with loose fiber flocks (branched off, for example, from the fiber flock feeder 2).

Examples of other possible embodiments of the invention are described below.

Figure 2:
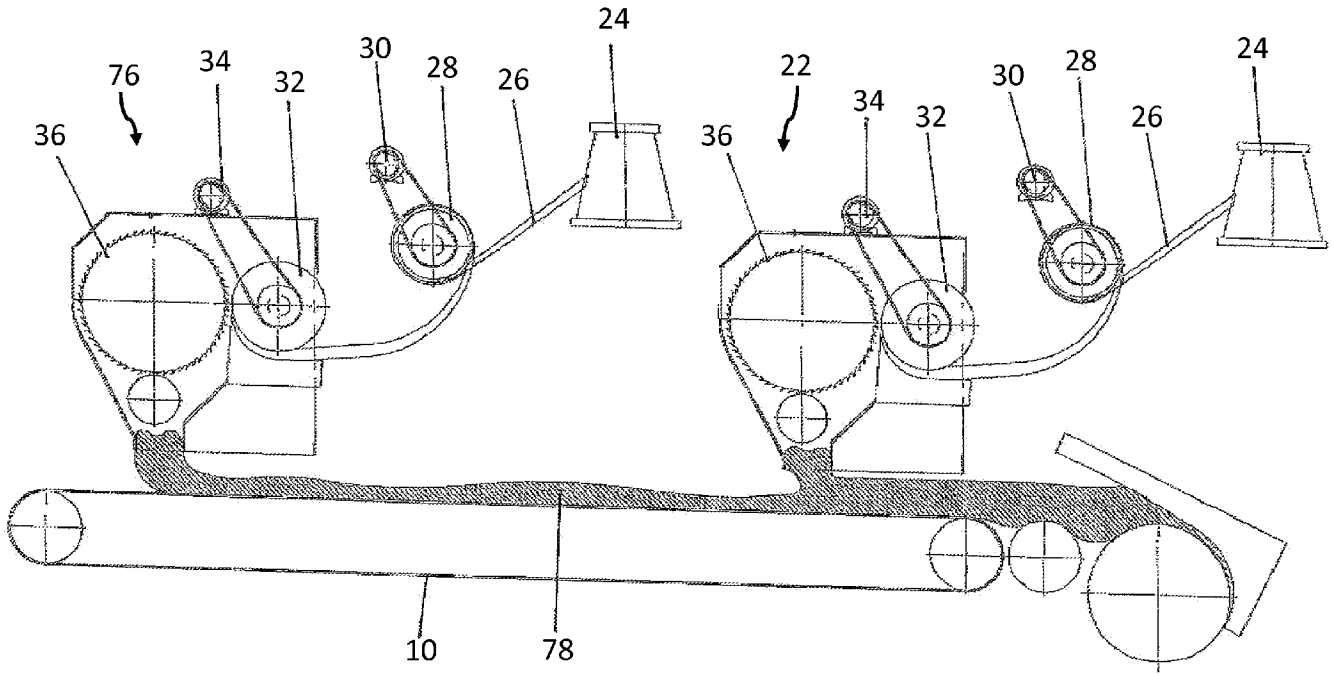
FIG. 2 shows a cross-sectional side view of a fleece-forming system with two feed devices according to the embodiment of the invention of FIG. 1 arranged one after the other.

In the device for forming a fleece illustrated in FIG. 2, two feed devices 22, 76 according to the invention are provided. In comparison to the embodiment shown in FIG. 1, the material dispensing device is now also designed as a first feed device 76. Both the first feed device 76 and second feed device 22 are substantially the same as feed device 22 shown in FIG. 1. The material dispensing device and the profile-changing device are thus substantially of the same design. Between two feed devices 76, 22, a measuring device 14 can again be arranged, which, like associated control unit 20, has been omitted from the figure for the sake of clarity. The automatic control can also be omitted, especially if the feed segments of second feed device 22 are offset from the feed segments of first feed device 76 by, for example, half the width of a feed segment. In this case, the laterally offset, segmented supply of fiber material in second feed device 22 can compensate precisely for the thin sections in fleece 78 present because of the segmented supply of fiber material in the first feed device 76, provided that the operating parameters of two feed devices 22, 76 are identical.

The pre-fleece formed in feed device 76 can have a relatively uniform profile if the spatial resolution of the feed segments is high, but it can also show a quite wavy transverse profile. In any case, the device described here, in which both first feed device 76 and second feed device 22 each consist of feed segments arranged next to each other, each segment being supplied with its own fiber sliver 26 or its own fiber fleece strip, makes it possible to form, with a high degree of accuracy, fleece 78 with a profile having the desired properties.

Feed device 76 or 22 does not necessarily have to be arranged transversely to the transport direction of the conveyor belt 10 but can instead be oriented in the transport direction of conveyor belt 10. In this case, feed device 76 or 22 can preferably be moved transversely to the transport direction of conveyor belt 10 above and over the maximum width of fiber flock mat 12 to be laid (not shown). Here again, movable feed device 76 or 22 comprises several feed segments, which are arranged horizontally next to each other in the transport direction of conveyor belt 10 and which are actuatable independently of each other.

If, for example, only second feed device 22 is designed as a transversely movable feed device, it is possible with this arrangement to dispense fibers oriented substantially longitudinally onto conveyor belt 10 in first feed device 76 and fibers oriented substantially transversely onto conveyor belt 10 in second feed device 22, so that the material properties of fiber flock mat 12 or of fleece 78 can be influenced in a targeted manner. Fiber flock mats 12 or fleeces 78 can thus be formed in this way which are not only highly uniform or which have a highly precise profile but which also comprise different orientations of the fiber or fiber flocks in different areas or layers of fiber flock mat 12 or fleece 78.

It is important here that movable feed device 22 comprises a material reservoir traveling along with it, so that it can accompany the lateral deflections of feed device 22. When a device for dispensing fiber slivers 26 or fiber fleece strips as shown in FIGS. 1 and 2 is used in conjunction with a transversely movable feed device 22, it also possible for only feed device 22, including feed roller 32, to move transversely, whereas dispensing device 24 remains stationary. If present, storage drum 28 can be moved along with feed device 22, or it can remain stationary. Appropriate hanging storage buffers between the elements just mentioned then provide the necessary material buffering for the transverse travel of feed device 22.

FIGS. 3-8 show additional preferred embodiments of the feed device according to the invention. For the sake of clarity, the elements which may be present such as measuring device 14 and control unit 20 are not shown. It should be clear, however, that second feed device 22 can be actuated by control unit 20 on the basis of the measurement results provided by measuring device 14.

Figure 3:
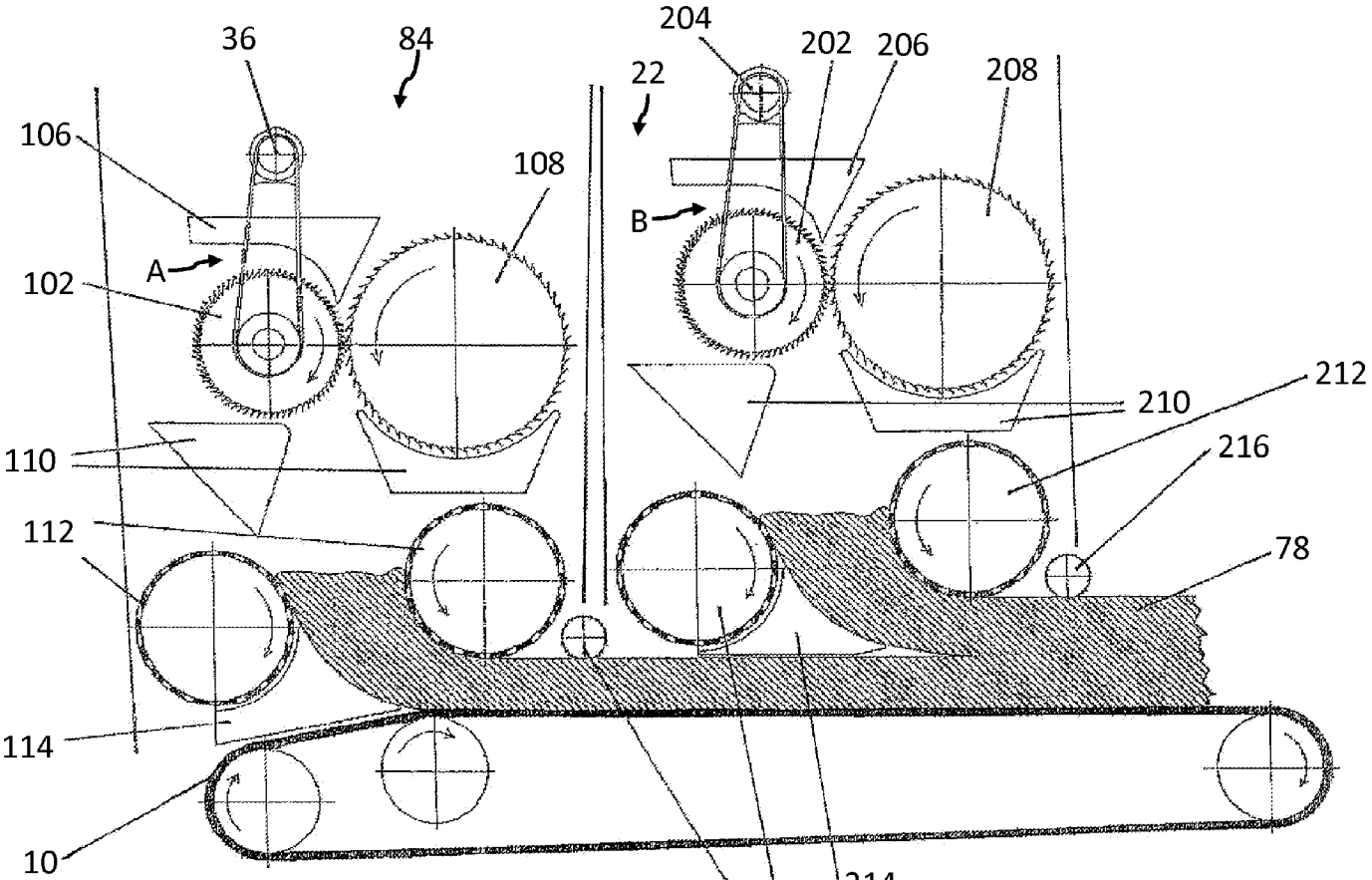
FIG. 3 shows a cross-sectional side view of a fleece-forming system with two feed devices according to another embodiment of the invention arranged one after the other.

In FIG. 3, the material dispensing device according to the invention is again designed as a feed device 84 or fleece former, which dispenses a first quantity of fiber material onto conveyor belt 10, which serves as a base for the formation of fleece 78. First feed device 84 comprises a plurality of feed rollers 102, arranged axially next to each other, one of which is assigned to each feed segment of feed device 84. The width of the individual feed segments is preferably the same as the width in the previous examples. Each feed roller 102 is driven by its own servomotor 104. In the cross-sectional side view shown, only one feed roller 102 and one servomotor 104 can be seen. The fiber material is drawn in the direction of arrow A by feed rollers 102 in a controlled manner and thus travels through and underneath the overhead trough 106. This trough assists the transport of the supplied fiber material to an opening cylinder 108, which cooperates with feed rollers 102 and strips off individual fiber flocks or individual fibers from feed rollers 102. The fiber material supplied in the direction of arrow A can be drawn in directly from a fiber flock shaft. The fiber material, however, is preferably supplied in the form of fiber slivers 26 or fiber fleece strips by means of, for example, the elements shown in FIG. 2 for supplying fiber slivers 26 or fiber fleece strips to feed rollers 32 as shown. Whereas, in the case of the example of FIG. 3, an overhead trough 106 is provided and the fiber material is conveyed by feed rollers 102 at an angle from above into the intermediate space between feed rollers 102 and opening cylinder 108, this can, as illustrated in FIG. 2, also be accomplished at an angle from below if desired. Only the relative rotational direction between feed rollers 102 and opening cylinder 108 would then be different, because feed rollers 102 would then move in the same rotational direction as opening cylinder 108.

Depending on the distance between feed rollers 102 and opening cylinder 108 and on the speed difference between feed rollers 102 and faster opening cylinder 108, opening cylinder 108 opens the fiber material of fiber sliver 26 or of the fiber fleece strip or of the fiber flocks coming from the shaft to different degrees, thus forming either fiber flocks or even individual fibers, which then drop down through feed device 84.

Appropriate guide elements 110 can be provided to define the travel of the fiber flocks or fibers. The fiber material individualized per feed segment by opening cylinder 108 finally arrives in an intermediate space between two screen drums 112, which are preferably driven at the same speed but in opposite directions. With the assistance of, for example, an additional trough 114, these screen drums 112 guide the fiber material in feed device 84 onto conveyor belt 10. The distance between two screen drums 112 and their relative heights are adjustable.

In the outlet area of feed device 84, a clamping cylinder 116 can be provided, which rotates at the same speed as conveyor belt 10 and compacts formed fleece 78 between itself and conveyor belt 10. If clamping cylinder 116 and conveyor belt 10 are moving faster than screen drums 112, then in the area between screen drums 112 and clamping cylinder 116 fleece 78 will be stretched in the transport direction of conveyor belt 10, which serves to orient the fibers in the fleece even more strongly in the longitudinal direction, i.e., in the transport direction of conveyor belt 10.

The profile-changing device is also designed as a second feed device 22 or fleece former, which comprises a plurality of individual fleece-forming locations. The design of second feed device 22 is substantially the same as that of first feed device 84 and is therefore not described in any further detail. The feed direction of the fiber material into feed device 22 in the example shown here is shown by the arrow B. The individual elements which have already been described with reference to first feed device 84 have the following reference numbers here: feed rollers 202, servomotors 204, overhead trough 206, opening cylinder 208, guide elements 210, screen drums 212, lower trough 214, and clamping cylinder 216.

Second feed device 22 shown in FIG. 3, like second feed devices 22 described with reference to the following figures, can also be combined at any time with another material dispensing device, such as with conventional fiber flock feeder 2 as shown in FIG. 1, or with feed device 76 according to FIG. 2.

Finally, it is also possible to combine first feed device 76, 84 shown in FIGS. 2-8 with other profile-changing devices.

The feed device according to the invention can be used in almost any area of a device for forming a fleece or a fiber flock mat, primarily to compensate for irregularities or to create a desired profile. One possible location where it can be used in addition to those already described is, for example, the area between the carding machine and the fleece layer or between the fleece layer and the solidification machine. Arranging more than two feed devices according to the invention one after the other is also conceivable.

Figure 4:
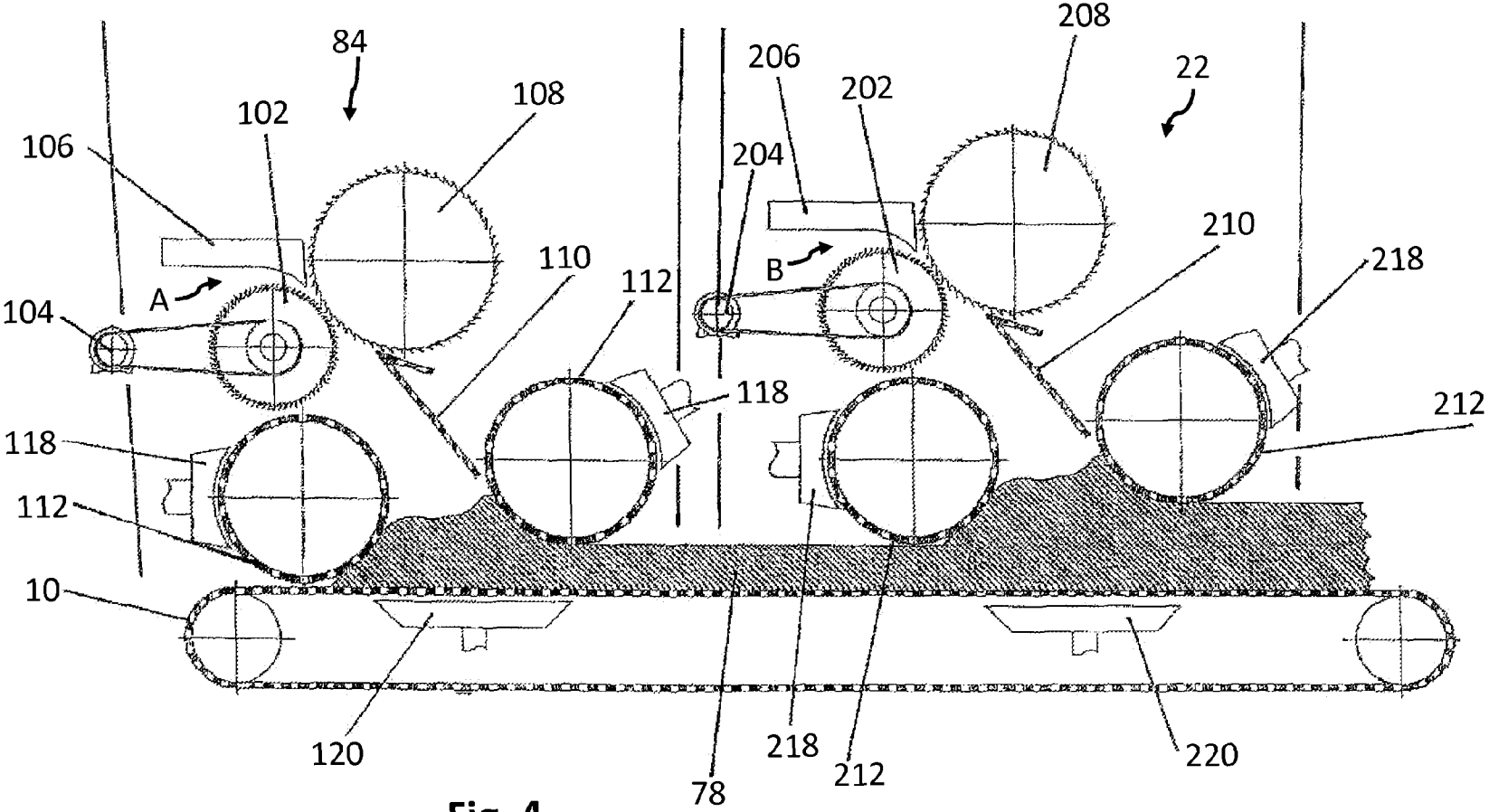
FIG. 4 shows a cross-sectional side view of a fleece-forming system with two feed devices according to another embodiment of the invention arranged one after the other.
Figure 5:
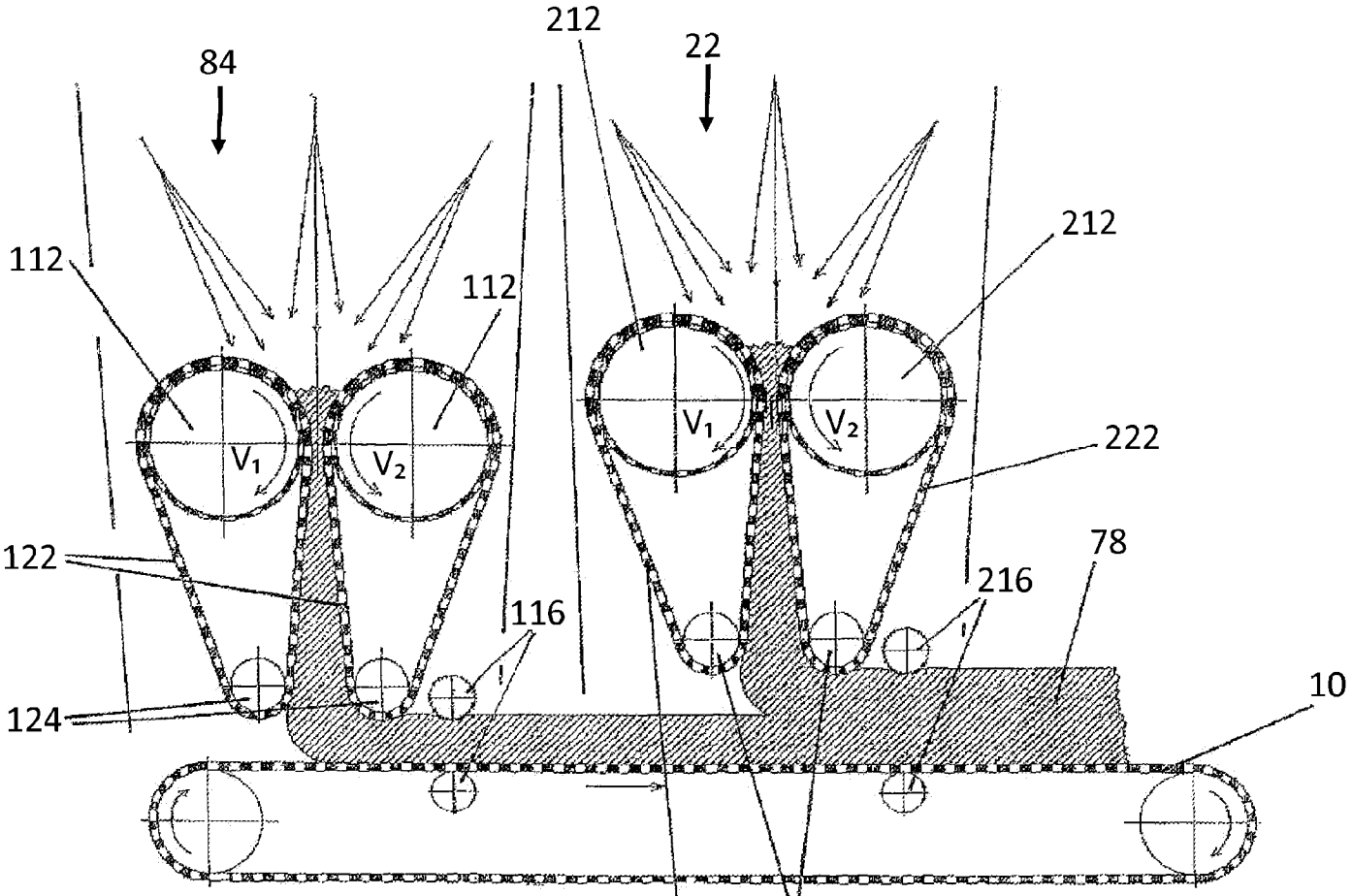
FIG. 5 shows a cross-sectional side view of a fleece-forming system with two feed devices according to another preferred embodiment of the invention arranged one after the other.

The embodiment of the device for forming a fleece shown in FIG. 4 is similar to the embodiment of FIG. 3, except that two feed devices 84, 22 have a different design. The fiber material is again drawn into feed device 84 in the direction of arrow A by means of independently driven feed rollers 102, arranged across the width of fleece 78 to be laid and axially next to each other. Feed rollers 102 in this case are at a slight angle under opening cylinder 108, and a perforated plate is provided in this case as guide element 110. Two screen drums 112 are again driven in opposite directions, wherein, in the embodiment shown, suction devices 118 for creating suction behind screen drums 112 are also shown. Conveyor belt 10 in the embodiment shown here is designed as a screen belt, underneath which suction device 120 also creates suction to draw the fiber material stripped from opening cylinder 108 onto the desired area of conveyor belt 10. In comparison to the embodiment in FIG. 3, left screen drum 112 is arranged closer to conveyor belt 10, so that lower trough 114 of FIG. 3 can be omitted.

Second feed device 22 in FIG. 4 is substantially of the same design as first feed device 84. The fiber material is introduced into feed device 22 in the direction of arrow B. The suction devices for screen drums 212 are designated by the number 218, and the suction device for creating suction underneath conveyor belt 10 in the area of profile-changing device 22 is designated by the number 220. Clamping cylinders 116, 216 (not shown here) of the preferred embodiment according to FIG. 3 could also be used here.

The embodiment of first feed device 84 and of second feed device 22 shown in FIG. 5 again comprises, in the infeed area (located above the arrows intended to show the falling fiber material), several feed rollers 102 arranged next to each other and an opening cylinder 108 (as also in FIGS. 8 and 9), but are not shown in FIG. 3 for clarity, In the case of FIG. 5, screen drums 112, which are driven in opposite directions, are partially wrapped by screen belts 122, which are led downward from screen drums 112 and are guided there around smaller deflecting pulleys 124. Deflecting pulleys 124 are arranged close to the surface of conveyor belt 10 and define a dispensing gap of first feed device 84. Conveyor belt 10 is again designed as a screen belt, but this time two opposing clamping cylinders 116 are arranged at the outlet of feed device 84, one above formed fleece 78 and one under the upper strand of conveyor belt 10. Clamping cylinders 116 are driven in opposite directions and run at the same speed as conveyor belt 10. When the speed of clamping cylinders 116 and of conveyor belt 10 is higher than the speeds V1 and V2 of screen drums 112, laid fleece 78 is again stretched in the longitudinal direction, that is, in the transport direction of the conveyor belt. This leads to an increase in the longitudinal orientation of the fibers in fleece 78.

It is also possible to omit two clamping cylinders 116, if no stretching is to be desired. The distance between screen belts 122 is variable, and the speeds V1 and V2 can also be adjusted independently of each other.

Second feed device 22 in the example of FIG. 5 is again basically identical to first feed device 84. As such, the two endless screen belts have been given the reference number 222 and the two lower deflecting pulleys the number 224.

Figure 6:
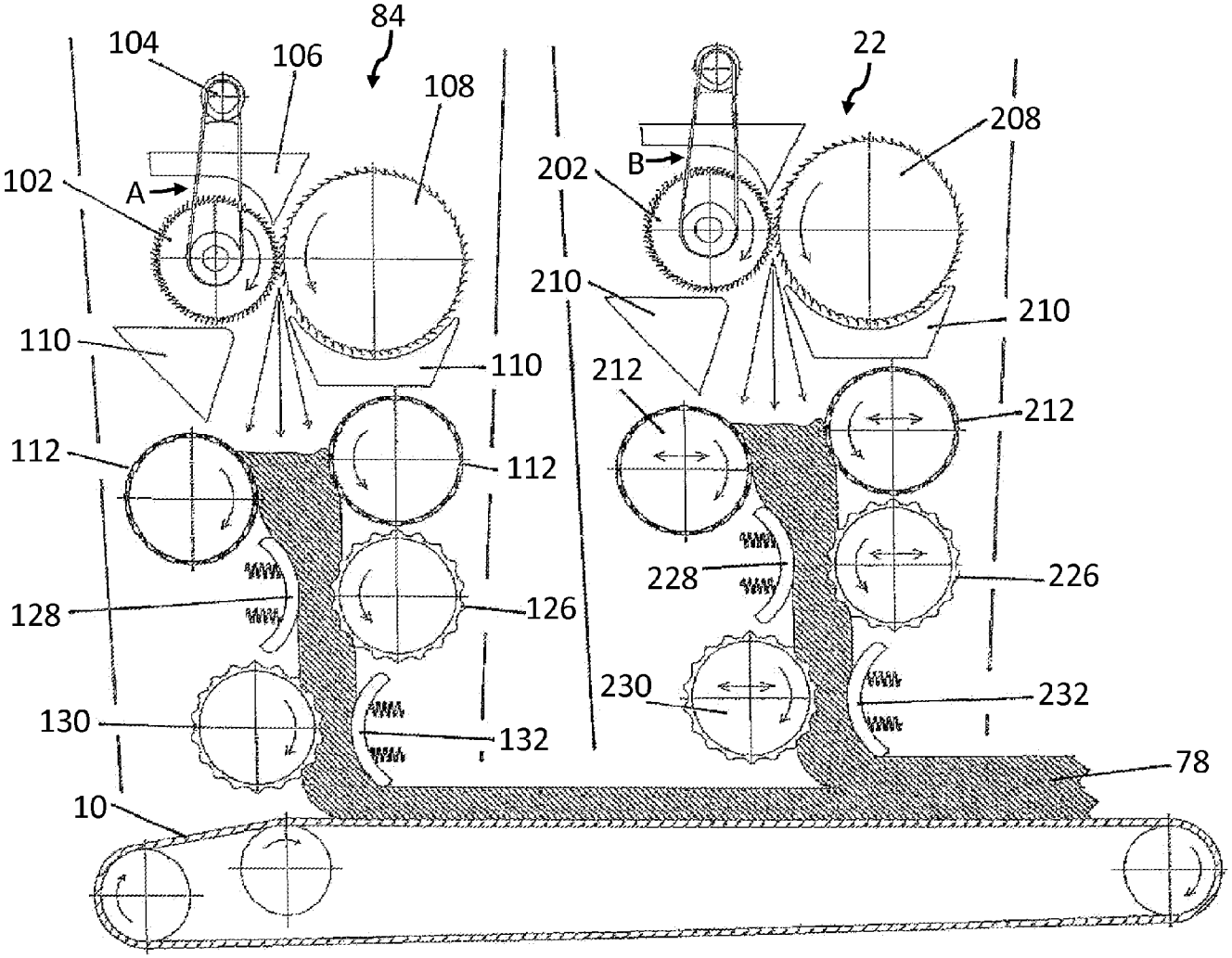
FIG. 6 shows a cross-sectional side view of a fleece-forming system with two feed devices according to another preferred embodiment of the invention arranged one after the other.

The embodiment of the device for forming a fleece shown in FIG. 6 is substantially identical to the embodiment according to FIG. 3 in the upper area down to two screen drums 112. Under two screen drums 112, however, a stretching device is now arranged. The stretching device in this case comprises an upper star cylinder 126 or a cylinder with surface fittings and opposite it a spring-supported counter-pressure plate 128. These two elements define between them a first clamping point for the fiber material. The stretching device also comprises a lower star cylinder 130 or cylinder with surface fittings and a lower, preferably spring-supported, counter-pressure plate 132, opposite lower star cylinder 130, with which it defines a second clamping point. Two star cylinders 126 and 130 are preferably arranged on opposite sides of the filling channel. The fiber material in the stretching channel is stretched when the rotational speed of lower star cylinder 130 is greater than the rotational speed of upper star cylinder 126. The speed of lower star cylinder 130 is preferably the same as the speed of conveyor belt 10. The stretching has the effect of increasing the longitudinal orientation of the fibers, so that a fleece 78 with fibers with a more pronounced orientation in the transport direction of the conveyor belt 10 is ultimately deposited onto conveyor belt 10. The form and arrangement of the elements for stretching can, of course, be varied in many different ways. For example, a pair of clamping cylinders (smooth, rubber-coated, or with surface fittings) or a pair of star cylinders can be used to define each clamping point.

Second feed device 22 described in connection with FIG. 6 is designed in substantially the same way as first feed device 84. The fiber material is supplied to feed device 22 in the direction of arrow B, and the elements newly added in comparison to the embodiment of FIG. 3 are upper star cylinder 226, upper counter-pressure plate 228, lower star cylinder 230, and lower counter-pressure plate 232.

Figure 7:
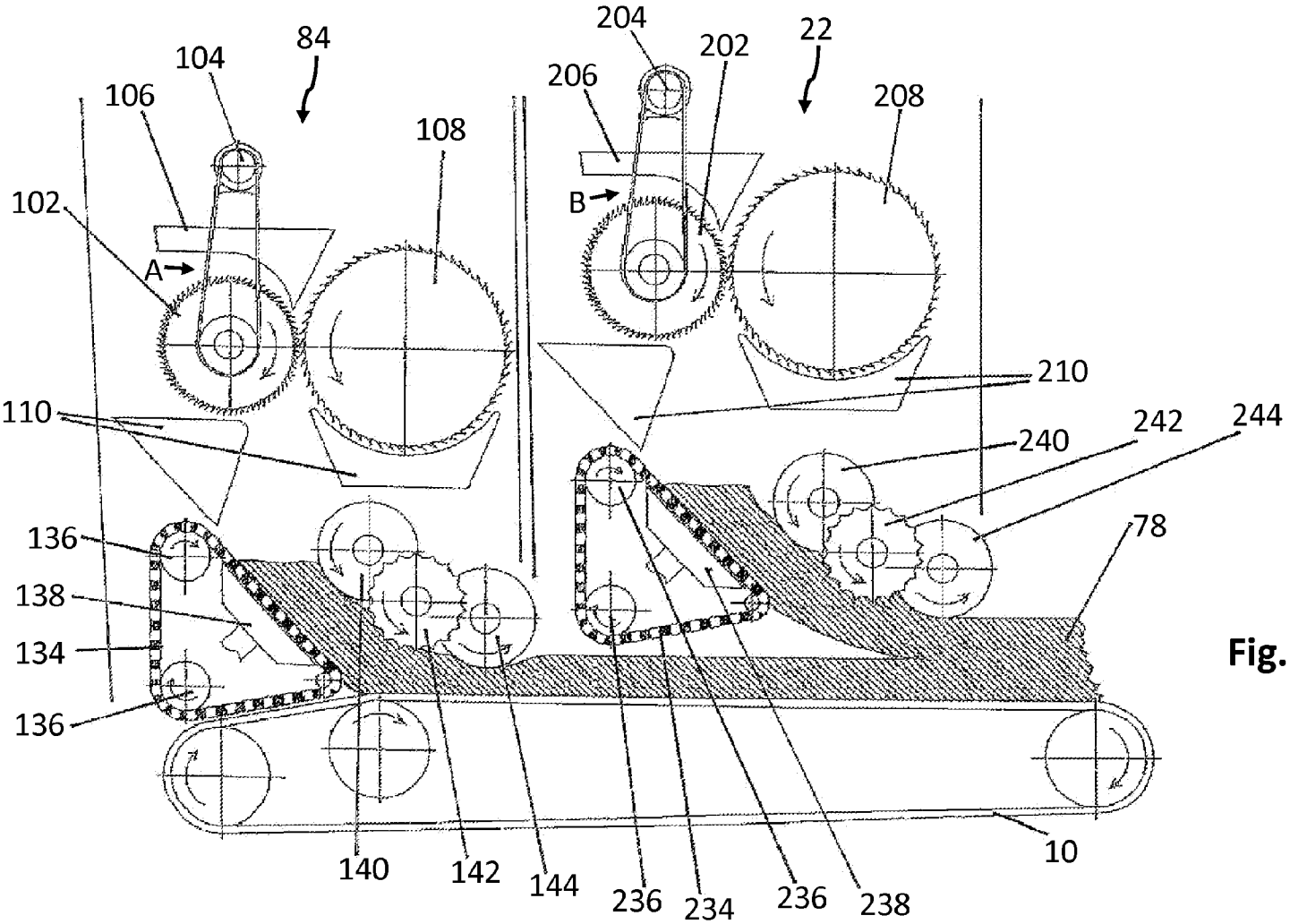
FIG. 7 shows a cross-sectional side view of a fleece-forming system with two feed devices according to another preferred embodiment of the invention arranged one after the other.

First feed device 84 shown in FIG. 7 is substantially the same as the embodiment according to FIG. 3, wherein two screen drums 112 have been replaced by other guide and stretching elements. On the left outer side, a screen belt 134 is arranged around several deflecting pulleys 136 in such a way that it defines a slanted guide surface for the fiber material leading toward conveyor belt 10. At least one of deflecting pulleys 136 is driven so that screen belt 134 travels along at the same speed as conveyor belt 10. In addition, screen belt 134 as shown in FIG. 7 can have a suction device 138 to create suction from underneath. Opposite the slanted guide surface of screen belt 134 is an upper disk-shaped clamping cylinder 140, which is driven at the same speed as screen belt 134 and which cooperates with screen belt 134 to define a first clamping point for the transported fiber material. At an angle underneath this clamping cylinder 140, a star cylinder 142 is arranged, which again cooperates with conveyor belt 10 to form a second clamping point for the fiber material. Another clamping cylinder 144 can be provided downstream from star cylinder 142 to densify fleece 78.

A stretching function is present when the speed of star cylinder 142, which is the same as that of conveyor belt 10, is greater than the speed of screen belt 134 and clamping cylinder 140. In this way, as already described in detail in the embodiments further above, the longitudinal orientation of the fibers of fleece 78 is increased. There are again many different ways in which the individual components can be designed in this embodiment as well, such designs lying well within the capacity of the person skilled in the art.

Second feed device 22 of FIG. 7 is substantially identical in design to first feed device 84. The elements which are new in comparison to FIG. 3 are screen belt 234, deflecting pulleys 236, suction device 238, clamping cylinder 240, star cylinder 242, and optional lower clamping cylinder 244.

Feed rollers 102, 202 shown in FIGS. 3-7 are each provided with surface fittings, the teeth of which project forward in the rotational direction of feed rollers 102, 202. It is also possible or even preferable for the teeth of the surface fittings of feed rollers 102, 202 to be directed backward with respect to the direction of rotation. It is also possible to use completely different types of surface fittings.

Figure 8:
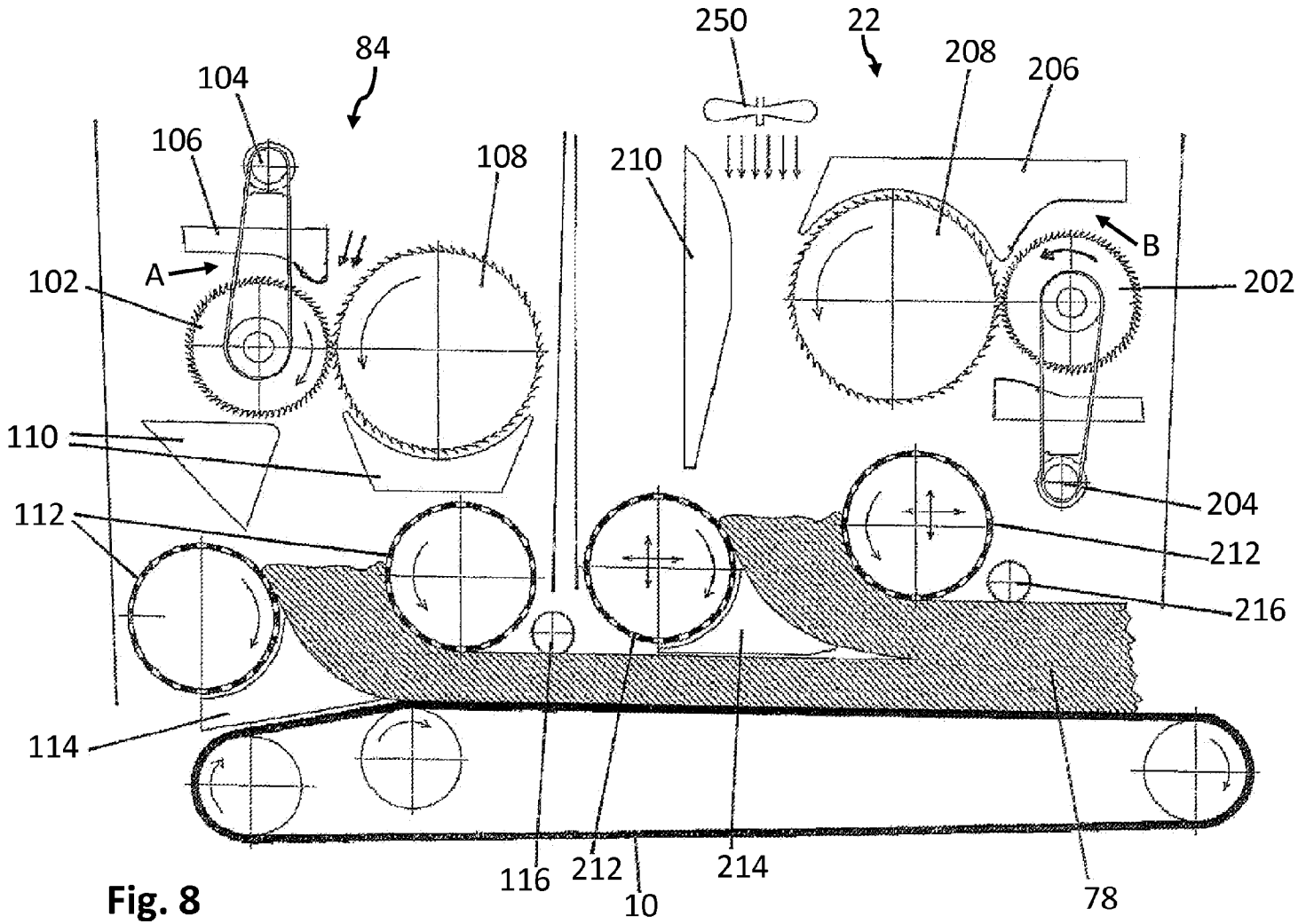
FIG. 8 shows a cross-sectional side view of a fleece-forming system with two feed devices according to another preferred embodiment of the invention arranged one after the other.

The embodiment of the device for forming a fleece shown in FIG. 8 comprises a second feed device 22, the lower part of which, from screen drums 212 on down, is the same as the embodiment seen in FIG. 3. The infeed area, however, is modified. The fiber material in this embodiment is introduced above feed rollers 202 in the direction of arrow B and is then conveyed from opening cylinder 208, which turns in the same direction as feed rollers 202, along overhead trough 206. Overhead trough 206 can also have a two-part design. Then, after half a rotation of opening cylinder 208, the fiber material drops into the dispensing shaft and finally arrives between screen drums 212. To assist the process of removing the fiber material from opening cylinder 208, an air stream generator 250 can be used, which allows an air stream to pass by opening cylinder 208 from above (aerodynamic fleece formation).

First feed device 84 of FIG. 8 is substantially the same as feed device 84 seen in FIG. 3. In addition, in the intermediate area between feed rollers 102 and opening cylinder 108, an air stream from above is provided, as indicated by the arrows, which helps to remove the fiber material from opening cylinder 108 and direct it downward. A measure of this type can also be applied in any of the other preferred embodiments of FIGS. 3-7.

The pre-fleece formed in feed device 84 can have a relatively uniform profile, but it can also have a very wavy transverse profile. In any case, it is possible with the device described herein to form a fleece 78 with a profile with the desired properties with extreme accuracy. Such is accomplished with the material dispensing device and the profile-changing device each consisting of an inventive feed device with adjacent feed segments, each of which is preferably supplied with its own fiber sliver 26 or its own fiber fleece strip. If desired, the feed segments of feed device 22 can be laterally offset from the feed segments of feed device 84 by a distance equal to, for example, half the width of a feed segment.

In the embodiments of FIGS. 3-8, only feed rollers 102, 202 have been described so far as individually actuatable, axially adjacent elements, each feed roller 102, 202 being assigned to a feed segment of feed device 84 or of feed device 22. It is also possible, however, for many other elements of feed device 84 or of feed device 22 shown in FIGS. 3-8 to be segmented. Segmenting in this way consists of segments arranged in a row next to each other, each being individually actuated, wherein in each case a segment of such other elements is assigned to each feed segment. This pertains, for example, to screen drums 112, 212, screen belts 122, 222, and star cylinders 126, 130, 226, 230 as well as to screen belts 134, 234 and to clamping cylinders 140, 240 and star cylinders 142, 242 opposite the belts.

All of the plates, belts, and cylinders shown as screen elements in the figures can be acted on by suction from underneath, or they can merely carry air away passively through the openings. Some of these elements can also be replaced completely by equivalent elements with a solid surface.

The person skilled in the art can also modify the type and design of the selected cylinders, belts, and troughs and the relative geometric arrangement of the individual parts in the embodiments described here to suit a particular purpose. Specifically, the distance between the cylinders and belts in the embodiments of FIGS. 3-7 is not shown to scale and can also be adjusted as desired. The embodiments described herein and the schematic drawings are intended only to represent the basic principles of the inventive idea.

Finally, the elements of the individual embodiments of feed devices 22, 76, 84 can be combined with each other in almost any way desired.

Reference throughout this specification to "the embodiment," "this embodiment," "the previous embodiment," "one embodiment," "an embodiment," "a preferred embodiment" "another preferred embodiment" "the example," "this example," "the previous example," "one example," "an example," "a preferred example t" "another preferred example" or similar language means that a particular feature, structure, or characteristic described in connection with the embodiment or example is included in at least one embodiment or example of the present invention. Thus, appearances of the phrases "in the embodiment," "in this embodiment," "in the previous embodiment," "in one embodiment," "in an embodiment," "in a preferred embodiment," "in another preferred embodiment," "in the example," "in this example," "in the previous example," "in one example," "in an example," "in a preferred example," "in another preferred example, and similar language throughout this specification may, but do not necessarily, all refer to the same embodiment.

Furthermore, the described features, advantages, and characteristics of the invention may be combined in any suitable manner in one or more embodiments or examples. One skilled in the relevant art will recognize that the invention may be practiced without one or more of the specific features or advantages of a particular embodiment or example. In other instances, additional features and advantages may be recognized in certain embodiments or examples that may not be present in all embodiments of the invention.

While the present invention has been described in connection with certain exemplary or specific embodiments or examples, it is to be understood that the invention is not limited to the disclosed embodiments or examples, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A feed device for supplying individualized fibers or fiber flocks to a transport device, which serves to transport a formed fleece or fiber flock mat further onward in a transport direction, wherein the feed device comprises:

a plurality of feed segments arranged horizontally next to each other, each feed segment comprising an independently actuatable feed roller, and at least one driven opening cylinder arranged adjacent to and cooperating with the plurality of feed rollers;

wherein each feed roller is supplied with a fiber sliver or a fiber fleece strip and a dispensing device for storing and dispensing the fiber sliver or the fiber fleece strip is assigned to each feed segment in such a way that each feed roller draws off the fiber sliver or the fiber fleece strip provided by the dispensing device.

2. The feed device of claim 1 further comprising a fiber flock shaft as a material reservoir for the feed rollers.

3. The feed device of claim 1 wherein each feed segment has a width in a range of 5-100 mm.

4. The feed device of claim 1 wherein each feed segment has a width in a range of 15-30 mm.

5. The feed device of claim 1 wherein each feed segment has a width in a range of 20-25 mm.

6. The feed device of claim 1 wherein each feed roller comprises surface fittings with teeth projecting backward with respect to the rotational direction of the feed roller, wherein the opening cylinder is driven in the same rotational direction as the feed rollers and comprises surface fittings with teeth projecting forward with respect to the rotational direction of the opening cylinder.

7. The feed device of claim 1 wherein each feed roller comprises surface fittings with teeth projecting backwards with respect to the rotational direction of the feed roller, wherein the opening cylinder is driven in a second rotational direction which is opposite the rotational direction of the feed roller and comprises surface fittings with teeth projecting forwards with respect to the second rotational direction.

8. The feed device of claim 1 wherein precisely one opening cylinder is provided, which extends transversely to the transport direction of the transport device and horizontally across all the feed segments.

9. The feed device of claim 1 wherein the feed segments are arranged next to each other in the direction transverse to the transport direction of the transport device.

10. The feed device of claim 1 wherein at least one other type of roller or conveyor belt is assigned to each feed segment, wherein the rollers or conveyor belt of the same type of all the feed segments are arranged next to each other in a direction transverse to the transport direction of the transport device and can be actuated independently of each other.

11. The feed device of claim 1 wherein each feed roller is driven by a servomotor.

12. The feed device of claim 1 wherein, between the dispensing device and the feed roller of each feed segment, a storage drum is arranged, which extends transversely to the transport direction of the transport device and horizontally across all the feed segments and around which a winding of each fiber sliver or of each fiber fleece strip provided by the dispensing device is wound.

13. A device for forming a fleece or fiber flock mat comprising:

a transport device for transporting a fleece or fiber flock mat in a transport direction; and a feed device including a plurality of feed segments arranged horizontally next to each other, each feed segment comprising an independently actuatable feed roller and at least one driven opening cylinder arranged adjacent to and cooperating with the feed rollers to individualize loose fiber flocks or fine fibers from strands of material transported by the feed rollers;

wherein the feed device is arranged above the transport device and the loose fiber flocks or fine fibers individualized by the at least one opening cylinder fall directly onto the transport device.

* * * * *